US008037878B2

(12) United States Patent
Kitagawa et al.

(10) Patent No.: US 8,037,878 B2
(45) Date of Patent: Oct. 18, 2011

(54) METHOD FOR SLICING WORKPIECE BY USING WIRE SAW AND WIRE SAW

(75) Inventors: Koji Kitagawa, Nishishirakawa (JP); Tadahiro Kato, Nishishirakawa (JP); Yukio Itoi, Nishishirakawa (JP); Tomiichi Sudou, Nishishirakawa (JP)

(73) Assignee: Shin-Etsu Handotai Co., Ltd., Tokyo (JP)

( * ) Notice: Subject to any disclaimer, the term of this patent is extended or adjusted under 35 U.S.C. 154(b) by 0 days.

(21) Appl. No.: 12/734,581

(22) PCT Filed: Nov. 17, 2008

(86) PCT No.: PCT/JP2008/003344

§ 371 (c)(1),
(2), (4) Date: May 11, 2010

(87) PCT Pub. No.: WO2009/075062

PCT Pub. Date: Jun. 18, 2009

(65) Prior Publication Data

US 2010/0252017 A1 Oct. 7, 2010

(30) Foreign Application Priority Data

Dec. 11, 2007 (JP) ..... 2007-320200

(51) Int. Cl.
*B28D 1/06* (2006.01)
*B24B 49/00* (2006.01)

(52) U.S. Cl. ..... 125/16.01; 451/5; 451/7

(58) Field of Classification Search ..... 125/16, 125/16.01; 451/5, 7
See application file for complete search history.

(56) References Cited

U.S. PATENT DOCUMENTS 5,269,285 A * 12/1993 Toyama et al. ..... 125/16.01
5,947,798 A * 9/1999 Toyama ..... 451/5
6,109,253 A * 8/2000 Ikehara ..... 125/12
(Continued)

FOREIGN PATENT DOCUMENTS

JP A-6-114828 4/1994
(Continued)

OTHER PUBLICATIONS

International Search Report issued in International Application No. PCT/JP2008/003344 by the International Bureau on Dec. 22, 2008.

*Primary Examiner* — Maurina Rachuba
(74) *Attorney, Agent, or Firm* — Oliff & Berridge, PLC

(57) ABSTRACT

The present invention is a wire saw in which a wire for slicing is wound around a plurality of rollers to form a wire row; the wire for slicing is driven axially in a reciprocating direction; a workpiece is sliced simultaneously at a plurality of points arranged in an axial direction by feeding the workpiece against the wire row with the workpiece cut into while a slurry is supplied to the wire for slicing; the wire saw controlling in such a manner that the workpiece is extracted while the wire is caused to travel at a speed of 2 m/min or less at the time of extracting the workpiece from the wire row after slicing the workpiece. As a result, there is provided a wire saw in which the workpiece sliced with the wire row of the wire saw can be extracted from the wire row with a simple structure without a negative influence on its slicing surface.

8 Claims, 2 Drawing Sheets

U.S. PATENT DOCUMENTS

| | | | | |
|---|---|---|---|---|
| 6,889,684 | B2 * | 5/2005 | McAulay et al. | 125/21 |
| 2007/0190912 | A1 * | 8/2007 | Ji et al. | 451/41 |
| 2008/0141994 | A1 * | 6/2008 | Skovgaard-Soerensen et al. | 125/12 |
| 2009/0253352 | A1 * | 10/2009 | Oishi et al. | 451/7 |
| 2010/0197202 | A1 * | 8/2010 | Branagan et al. | 451/36 |
| 2010/0200865 | A1 * | 8/2010 | Fujito et al. | 257/76 |

FOREIGN PATENT DOCUMENTS

| | | |
|---|---|---|
| JP | A-6-155450 | 6/1994 |
| JP | A-8-11047 | 1/1996 |
| JP | A-9-262826 | 10/1997 |
| JP | A-2003-275950 | 9/2003 |
| JP | A-2007-173721 | 7/2007 |

* cited by examiner

METHOD FOR SLICING WORKPIECE BY USING WIRE SAW AND WIRE SAW

TECHNICAL FIELD

The present invention relates to a method for slicing a workpiece (e.g., a silicon ingot or an ingot of a compound semiconductor) into many wafers by using a wire saw.

BACKGROUND ART

In recent years, an increase in size of a wafer is demanded, and a wire saw is mainly used to slice a workpiece with this increase in size.

The wire saw is an apparatus that causes a wire (a high-tensile steel wire) to travel at a high speed, presses a workpiece against the wire to cut the workpiece while applying a slurry to the wire and thereby slices the workpiece into many wafers at the same time (see Japanese Patent Laid-open (Kokai) No. H09-262826).

Here, an outline of an example of a conventionally general wire saw is shown in FIG. 3.

As shown in FIG. 3, a wire saw 101 mainly includes a wire 102 for slicing a workpiece, grooved rollers 103 around which the wire 102 is wound, a mechanism 104 for giving the wire 102 a tensile force, a mechanism 105 for feeding the workpiece to be sliced downward, and a mechanism 106 for supplying a slurry at the time of slicing.

The wire 102 is unreeled from one wire reel 107 and reaches the grooved rollers 103 via the tensile-force-giving mechanism 104 composed of a powder clutch (a constant torque motor 109), a dancer roller (a dead weight) (not shown) and the like through a traverser 108. The wire 102 is wound around this grooved rollers 103 for approximately 300 to 400 turns to form a wire row, and then taken up by a wire reel 107' via the other tensile-force-giving mechanism 104'.

Moreover, each of the grooved rollers 103 is a roller that has a steel cylinder of which a polyurethane resin is pressed in the periphery and that has grooves formed at a fixed pitch on a surface thereof. The wound wire 102 can be driven in a reciprocating direction for a predetermined traveling distance by a driving motor 110.

It is to be noted that the workpiece-feeding mechanism 105 feeds the workpiece, toward the wire 102 wound around the grooved rollers 103 by holding and pushing down the workpiece at the time of slicing the workpiece.

Moreover, nozzles 115 are provided near the grooved rollers 103 and the wound wire 102, and a slurry can be supplied to the wire 102 from a slurry tank 116 at the time of slicing. Additionally, a slurry chiller 117 is connected with the slurry tank 116 so that a temperature of the slurry to be supplied can be adjusted.

With the wire saw 101, an appropriate tensile force is applied to the wire 102 with a wire-tensile-force-giving mechanism 104, and the workpiece is sliced while the wire 102 is caused to travel in a reciprocating direction by the driving motor 110.

The slicing of the workpiece is finished by cutting the workpiece until the wire reaches a pad plate, which holds the workpiece. Then the sliced workpiece is extracted from the wire row by reversing a direction of feeding the workpiece.

As the wire saw for preventing the wire from lifting by being caught on the sliced portion at the time of extracting the workpiece from the wire row, there is disclosed the wire saw having a means for restricting the lift of the wire by pushing against the wire in the vicinity of a wire entrance point of the workpiece with a pair of restricting members, which compose the means for restricting in Japanese Patent Laid-open (Kokai) No. H08-11047.

However, when the present inventors sliced the workpiece into wafers by using the general wire saw as described above and examined a shape of the sliced wafer, a large Warp was generated.

The Warp is one of important qualities for slicing of a semiconductor wafer. Hence, the more quality demand of a product increases, the more demand of reduction of the Warp increases.

As an example of a negative influence on a workpiece quality, there is a problem that a workpiece slicing surface is damaged by the slurry remaining on the workpiece slicing surface at the time of extracting the sliced workpiece from the wire row after slicing the workpiece. There is disclosed the wire saw that enhances a tensile force applied to the wire at the time of extracting the sliced workpiece from the wire row in order to suppress a negative influence on the workpiece slicing surface in Japanese Patent Laid-open (Kokai) No. 2003-275950.

DISCLOSURE OF INVENTION

In general, the slurry supplied to the wire for slicing is composed of fine abrasive grains suspended in an oily or an aqueous coolant. Since the abrasive grains are easily separated from a fluid component in condition where the slurry is not agitated, the slurry that changes a high viscosity one due to evaporation of the fluid component is apt to remain on the workpiece after slicing. Therefore, when the workpiece is extracted from the wire row in this condition, a so-called saw mark is apt to be generated on the workpiece slicing surface by damage to the workpiece slicing surface due to the wire row, thereby Warp is degraded and quality degradation occurs.

The saw mark is generated in a streaky shape in the direction of a right angle to the direction of feeding the workpiece, that is, a traveling direction of the wire. The present inventors thought that the saw mark is generated by moving the slurry remaining on the surface of the workpiece in a traveling direction of the wire along with travel of the wire.

Accordingly, this can be prevented by stopping the travel of the workpiece at the time of extracting the workpiece. However, when the workpiece is extracted in condition where the travel of the wire is stopped, the wire row is locally caught on particularly a portion where the abrasive grains cohere to adhere to the surface of the workpiece among the slurry remaining on the surface of the workpiece, and thereby disconnect of the wire occurs.

In view of the above-explained problems; it is an object of the present invention to provide a wire saw that enables extracting the sliced workpiece from the wire row with a simple structure without a negative influence on the slicing surface of the workpiece that is sliced with the wire row of the wire saw.

To achieve this object, the present invention provides a method for slicing a workpiece by using a wire saw, including: winding a wire for slicing around a plurality of rollers to form a wire row; driving the wire for slicing axially in a reciprocating direction; slicing the workpiece simultaneously at a plurality of points arranged in an axial direction by feeding the workpiece against the wire row with the workpiece cut into while supplying a slurry to the wire for slicing; wherein the workpiece is extracted while the wire is caused to travel at a speed of 2 m/min or less at the time of extracting the workpiece from the wire row after slicing the workpiece.

In this manner, when the workpiece is extracted while the wire is caused to travel at a speed of 2 m/min or less at the time of extracting the workpiece from the wire row after slicing the workpiece, the wire row is not locally caught on particularly the portion where abrasive grains cohere to adhere to the surface of the workpiece among the slurry remaining on the surface of the workpiece, the disconnect of the wire for slicing is not caused at the time of extracting the sliced workpiece from the wire row, and the saw mark due to extracting the workpiece can be consequently suppressed.

In this case, the wire is preferably caused to travel at the time of extracting the workpiece in such a manner that both traveling distances in a forward direction and a backward direction are 1 m or less respectively.

In this manner, when the wire is caused to travel at the time of extracting the workpiece in such a manner that both traveling distances in a forward direction and a backward direction are 1 m or less respectively, the slurry adhering to the surface of the workpiece can be easily removed and thereby the saw mark caused by extracting the workpiece can be effectively prevented.

In this case, a temperature of the slurry supplied at the time of extracting the workpiece is preferably higher than a temperature of the slurry at the end of slicing.

In this manner, when a temperature of the slurry supplied at the time of extracting the workpiece is higher than the temperature of the slurry at the end of slicing, the slurry adhering to the surface of the workpiece can be easily removed and thereby the saw mark caused by extracting the workpiece can be more effectively prevented.

Furthermore, the present invention provides a wire saw in which a wire for slicing is wound around a plurality of rollers to form a wire row; the wire for slicing is driven axially in a reciprocating direction; a workpiece is sliced simultaneously at a plurality of points arranged in an axial direction by feeding the workpiece against the wire row with the workpiece cut into while a slurry is supplied to the wire for slicing; the wire saw controlling in such a manner that the workpiece is extracted while the wire is caused to travel at a speed of 2 m/min or less at the time of extracting the workpiece from the wire row after slicing the workpiece.

In this manner, the wire saw according to the present invention controls in such a manner that the workpiece is extracted while the wire is caused to travel at a speed of 2 m/min or less at the time of extracting the workpiece from the wire row after slicing the workpiece, and thereby enables suppressing an occurrence of the disconnect of the wire and the saw mark and extracting the workpiece sliced by using the wire saw from the wire row without a negative influence on its slicing surface.

In this case, the wire saw preferably controls the wire to be caused to travel at the time of extracting the workpiece in such a manner that both traveling distances in a forward direction and a backward direction are 1 m or less respectively.

In order to remove the slurry adhering to the surface of the workpiece, it is more effective that the traveling direction of the wire is switched to be reciprocated at such short intervals that both traveling distances in a forward direction and a backward direction are 1 m or less respectively than the wire is caused to travel in the same direction.

As described above, the wire saw according to the present invention can easily remove the slurry adhering to the surface of the workpiece and can effectively prevent the saw mark caused by extracting the workpiece.

In this case, the wire saw preferably controls a temperature of the slurry supplied at the time of extracting the workpiece so as to be higher than a temperature of the slurry at the end of slicing.

In this manner, the wire saw according to the present invention controls the temperature of the slurry supplied at the time of extracting the workpiece so as to be higher than the temperature of the slurry at the end of slicing, thereby can easily remove the slurry adhering to the surface of the workpiece and can effectively prevent the saw mark caused by extracting the workpiece.

Since the wire saw according to the present invention controls in such a manner that the workpiece is extracted while the wire is caused to travel at a speed of 2 m/min or less at the time of extracting the workpiece from the wire row after slicing the workpiece, the saw mark can be reduced without the disconnect of the wire and the workpiece sliced with the wire row of the wire saw can be extracted without a negative influence on the slicing surface of the workpiece.

BEST MODE FOR CARRYING OUT THE INVENTION

Hereinafter, an embodiment according to the present invention will be explained, but the present invention is not restricted thereto.

When the workpiece is sliced by using a conventional wire saw, there is a problem that the saw mark is generated by moving the slurry remaining on the surface of the workpiece in a traveling direction of the wire along with travel of the wire at the time of extracting the workpiece from the wire row after slicing the workpiece, and thereby the Warp is degraded. On the other hand, when the workpiece is extracted in condition where the travel of the wire is stopped to prevent this, the wire row is locally caught on particularly the portion where abrasive grains cohere to adhere to the surface of the workpiece among the slurry remaining on the surface of the workpiece, and consequently the disconnect of the wire occurs.

In view of the problems, the present inventors thought that the wire is caused to travel at a minimum speed where the slurry can be removed at the time of extracting the workpiece from the wire row after slicing the workpiece. That is, the present inventors found that the workpiece can be extracted with suppressing generation of the saw mark and degradation of the Warp without an occurrence of the disconnect of the wire by controlling in such a manner that the workpiece is extracted while the wire is caused to travel at a speed of 2 m/min or less. In addition, the slurry adhering to the surface of the workpiece can be more easily removed and the saw mark caused by extracting the workpiece can be effectively prevented by controlling the wire to be caused to travel at the time of extracting the workpiece in such a manner that both traveling distances in a forward direction and a backward direction are 1 m or less respectively, or by controlling the temperature of the slurry supplied at the time of extracting the workpiece so as to be higher than the temperature of the slurry at the end of slicing.

Figure 1:
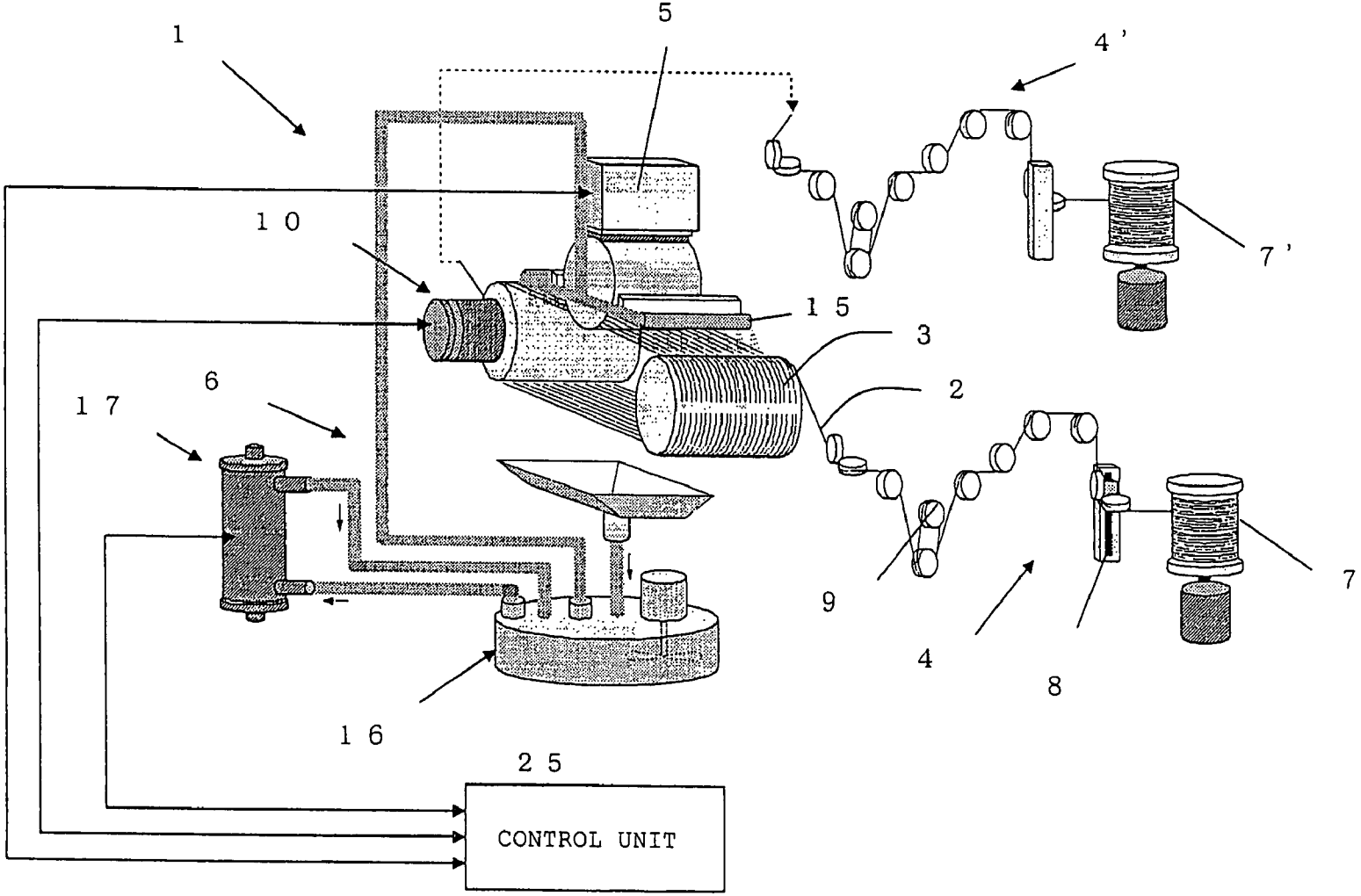
FIG. 1 is a schematic view showing an example of the wire saw according to the present invention.

FIG. 1 is a schematic view showing an example of the wire saw according to the present invention.

As shown in FIG. 1, the wire saw 1 according to the present invention mainly includes the wire 2 for slicing the workpiece, grooved rollers 3 around which the wire 2 is wound, a mechanism for giving the wire 2 a tensile force 4, a mechanism for feeding the workpiece to be sliced downward 5, a mechanism for supplying a slurry 6 at the time of slicing and the like.

The wire 2 is unreeled from one wire reel 7 and reaches the grooved rollers 3 via the tensile-force-giving mechanism 4 composed of a powder clutch (a constant torque motor 9), a dancer roller (a dead weight) (not shown) and the like through a traverser 8. The wire 2 is wound around this grooved rollers 3 for approximately 300 to 400 turns to form the wire row, and then taken up by a wire reel 7' via the other tensile-force-giving mechanism 4'. This constitution is the same as a conventional wire saw.

Figure 2:
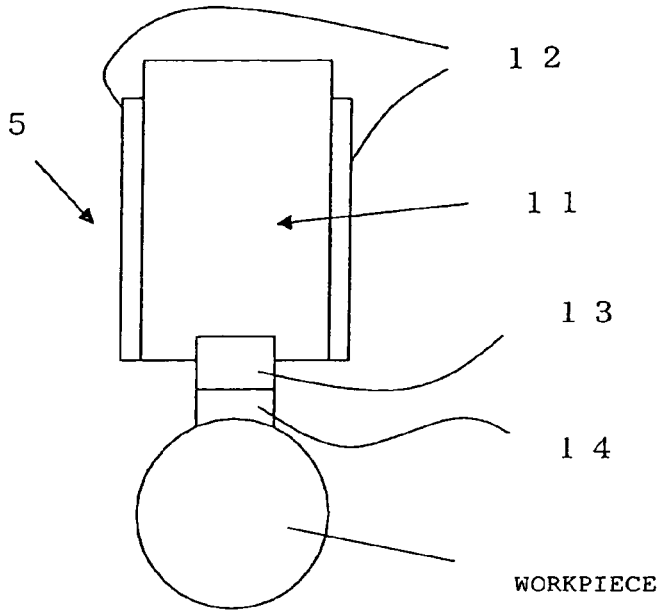
FIG. 2 is a schematic view showing an example of a workpiece-feeding mechanism that can be used in the present invention.
Figure 3:
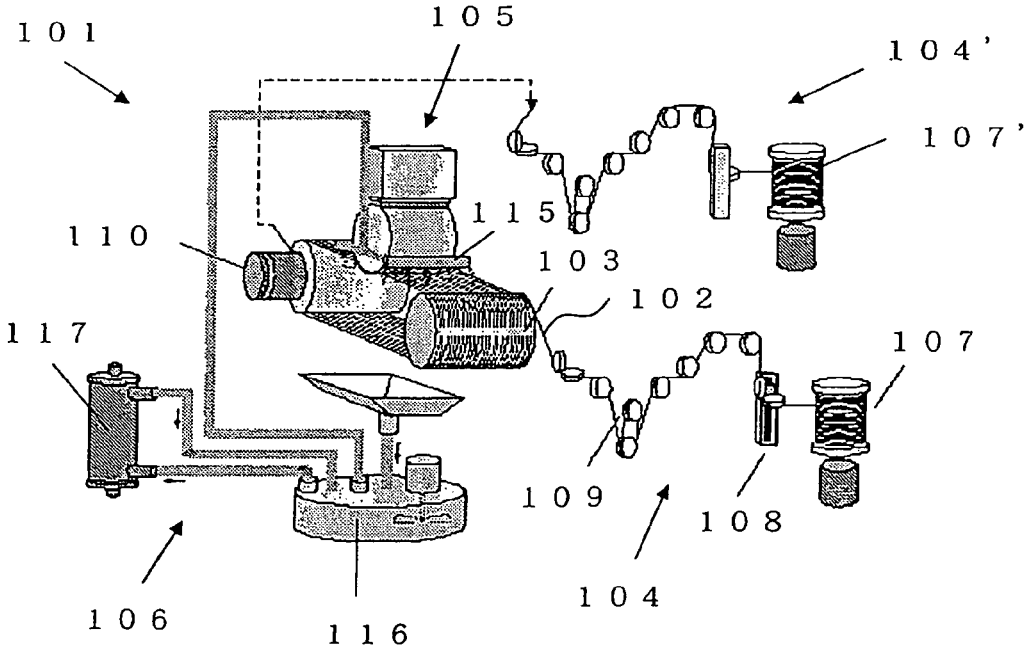
FIG. 3 is a schematic view showing an example of a conventional wire saw.

FIG. 2 shows an example of the workpiece-feeding mechanism that can be used in the present invention. As shown in FIG. 2, the workpiece is adhered to a pad plate 14. The pad plate 14 is held by a workpiece plate 13. The workpiece is held by a workpiece-holding portion 11 of the workpiece-feeding mechanism 5 through the pad plate 14 and the workpiece plate 13.

This workpiece-feeding mechanism 5 includes the workpiece-holding portion 11 that is used to hold and push down the workpiece and an LM guide 12. Driving the workpiece-holding portion 11 along the LM guide 12 under control of a computer enables feeding the held workpiece at a previously programmed feed speed.

The workpiece held with the workpiece-holding portion 11 of the workpiece-feeding mechanism 5 as described above is fed to the wire 2 that is located below with the workpiece-feeding mechanism 5 at the time of slicing. The workpiece-feeding mechanism 5 feeds the workpiece downward until the wire reaches the pad plate 14 to finish slicing the workpiece. Then the sliced workpiece is extracted from the wire row by reversing the direction of feeding the workpiece.

Moreover, each of the grooved rollers 3 is a roller that has a steel cylinder of which a polyurethane resin is pressed in the periphery and that has grooves formed at a fixed pitch on a surface thereof. The wound wire 2 can be driven in a reciprocating direction by a driving motor 10.

On the other hand, nozzles 15 are arranged above the wire 2 that is wound around the grooved rollers 3 and that travels axially in a reciprocating direction at the time of slicing so that the slurry can be supplied to the wire 2 at the time of slicing the workpiece.

Moreover, a slurry tank 16 is provided with a slurry chiller 17 so that the temperature of the slurry to be supplied can be adjusted. It is to be noted that the present invention is not of course restricted by the constitution shown in FIG. 1. For example, the supply temperature of the slurry can be adjusted by providing with other heat exchangers.

Furthermore, the slurry chiller 17, the driving motor 10 and the workpiece-feeding mechanism 5 are connected with a control unit 25.

This control unit 25 has a function of controlling a traveling speed of the wire 2 through the driving motor 10, a function of controlling the traveling distance of the wire 2 that reciprocates in a forward direction and a backward direction respectively through the driving motor 10, a function of controlling the temperature of the slurry supplied to the wire 2 through the slurry chiller 17 and a function of controlling feeding the workpiece against the wire row with the workpiece cut into and feeding the workpiece to extract the workpiece from the wire row through the workpiece-feeding mechanism 5.

Here, the mechanism for supplying a slurry 6, that is, a means for supplying the slurry to the grooved rollers 3 (the wire 2) will be explained. In the mechanism for supplying a slurry, the slurry tank 16 is connected with the nozzles 15 through the slurry chiller 17 controlled by the control unit 25 so that the temperature of the slurry to be supplied can be adjusted by the slurry chiller 17, and then the slurry can be supplied to the grooved rollers 3 (the wire 2) through the nozzles 15. The supply temperature of the slurry can be controlled to be a desired temperature by the control unit 25. However, a control means is not particularly restricted thereto.

The wire saw according to the present invention controls the workpiece-feeding mechanism 5 and the driving motor 10 with the control unit 25 to control in such a manner that the workpiece is extracted from the wire row while the wire is caused to travel at a speed of 2 m/min or less after slicing the workpiece and to control the wire to be caused to travel at the time of extracting the workpiece in such a manner that both traveling distances in a forward direction and a backward direction are 1 m or less respectively. In addition, the wire saw according to the present invention controls the slurry chiller 17 to control the temperature of the slurry supplied at the time of extracting the workpiece so as to be higher than the temperature of the slurry at the end of slicing.

Next, the method for slicing a workpiece by using a wire saw according to the present invention will be explained.

The control unit 25 drives the workpiece-holding portion 11 along the LM guide 12 to push down the workpiece in condition where the wire 2 is driven axially and the slurry is supplied to the wire 2 with the mechanism for supplying a slurry 6. The workpiece is thereby fed against the wire row that travels, for example, at 400 to 800 m/min with the workpiece cut into. A feed speed at the time of feeding the workpiece against the wire row with the workpiece cut into can be, for example, 0.2 to 0.4 mm/min. These conditions are not of course restricted thereto.

The wire can be caused to travel in a reciprocating direction at the time of slicing the workpiece and the traveling distance can be, for example, 400 to 600 m. The temperature of the slurry to be supplied at the time of slicing can be, for example, 15 to 30° C. These conditions are not of course restricted thereto.

The slicing of the workpiece proceeds as described above, the feeding is stopped when the wire row reaches the pad plate on an upper surface of the workpiece, that is, when the slicing of the workpiece is finished.

Then, the control unit 25 controls the driving motor 10 to cause the wire to travel at a predetermined traveling speed of 2 m/min or less. After that, the workpiece is extracted from the wire row upward by reversing the direction of the feeding with the workpiece-feeding mechanism 5 from that at the time of slicing the workpiece.

A feed speed at the time of extracting the workpiece from the wire row can be, for example, 5 to 100 mm/min and is more preferably 10 to 50 mm/min.

In this manner, when the control unit 25 controls the driving motor 10 to cause the wire to travel at a predetermined traveling speed of 2 m/min or less, an amount of the Warp and the saw mark to be generated in the wafer sliced by using the wire saw according to the present invention can be reduced in comparison with the wafer sliced by using a conventional wire saw.

The saw mark and the Warp are generated when the traveling speed of the wire exceeds 2 m/min at the time of extracting the workpiece from the wire row. To avoid this problem, the traveling speed of the wire must be 2 m/min or less and is more preferably 1 m/min or less. A lower limit of the traveling speed of the wire is not particularly restricted, but the lower limit of the traveling speed of the wire can be 0.1 m/min or more.

Furthermore, the wire can be controlled to travel in a reciprocating direction for a predetermined traveling distance of 1 m or less while the workpiece is extracted from the wire row upward.

As mentioned above, the control unit 25 is connected with the driving motor 10 and can control to reverse the traveling direction of the wire 2 after the wire 2 travels for a predetermined traveling distance.

This control enables more easily removing the slurry adhering to the surface of the workpiece and effectively preventing the saw mark and the Warp caused by extracting the workpiece.

It is preferable that the foregoing traveling distance for which the wire is caused to travel in a reciprocating direction is 1 m or less at the time of extracting the workpiece from the wire row, but may be not less than 1 m. A lower limit of the traveling distance for which the wire is caused to travel in a reciprocating direction is not particularly restricted, but the lower limit of the traveling distance can be 0.1 m or more.

Furthermore, the temperature of the slurry supplied to the wire is preferably controlled so as to be higher than the temperature of the slurry at the end of slicing while the workpiece is extracted from the wire row upward.

As mentioned above, the supply temperature of the slurry is controlled with the slurry chiller 17 that is controlled with the control unit 25, and the slurry having a higher temperature than the temperature of the slurry at the end of slicing is supplied at the time of extracting the workpiece from the wire row after the feeding of the workpiece is stopped.

In this manner, supplying the slurry having a high temperature at the time of extracting the workpiece enables softening the slurry adhering to the surface of the workpiece to be removed easily and effectively preventing the generation of the saw mark and the degradation of the Warp due to extracting the workpiece.

The supply temperature of the slurry at the time of extracting the workpiece from the wire row can be, for example, 35 to 50° C. when the supply temperature of the slurry at the time of slicing the workpiece is 15 to 30° C.

As described above, in the method for slicing a workpiece by using a wire saw according to the present invention in which the workpiece is extracted while the wire is caused to travel at a speed of 2 m/min or less at the time of extracting the workpiece from the wire row after slicing the workpiece, the workpiece sliced with the wire row can be extracted from the wire row without a negative influence on its slicing surface.

Hereinafter, the present invention will be explained in more detail based on examples, but the present invention is not restricted thereto.

EXAMPLE 1

The wire saw shown in FIG. 1 was used to control the traveling speed of the wire, both traveling distances of the wire in a forward direction and a backward direction and the supply temperature of the slurry supplied to the wire at the time of slicing the workpiece respectively and to slice a silicon ingot having a diameter of 8 inches (200 mm) into wafers based on the method for slicing according to the present invention.

The traveling speed of the wire was 600 m/min at the time of slicing the workpiece. The wire was caused to travel in a reciprocating direction in such a manner that both traveling distances in a forward direction and a backward direction were 500 m or less to slice the workpiece. The supply temperature of the slurry was 25° C. at the end of slicing.

The traveling speed of the wire was 2 m/min at the time of extracting the workpiece from the wire after slicing the workpiece. The traveling distance in a forward direction was 1 m and the traveling distance in a backward direction was 0.5 m at the time of extracting the workpiece. The supply temperature of the slurry was the same as the temperature at the end of slicing.

The present inventors sliced the workpiece in the foregoing conditions and examined a state of the surface of the workpiece after slicing the workpiece. As a result, the saw mark and the amount of the Warp were reduced in comparison with the case of using a conventional wire saw.

EXAMPLE 2

The workpiece was sliced in the same conditions as Example 1 except that the traveling speed of the wire was 1 m/min at the time of extracting the workpiece from the wire, and the same evaluation as Example 1 was made.

As a result, it was revealed that the saw mark and the amount of the Warp on the surface of the workpiece were reduced in comparison with the case of using a conventional wire saw and that the amount of the reduction was larger than Example 1 when the traveling speed of the wire was 1 m/min, which was 2 m/min or less, at the time of extracting the workpiece from the wire.

EXAMPLE 3

The workpiece was sliced in the same conditions as Example 1 except that the supply temperature of the slurry was 35° C. at the time of extracting the workpiece, and the same evaluation as Example 1 was made.

As a result, it was revealed that the saw mark and the amount of the Warp on the surface of the workpiece were reduced in comparison with the case of using a conventional wire saw and that the amount of the reduction was larger than Example 1 when the supply temperature of the slurry was 35° C., which was higher than the temperature of the slurry at the end of slicing, at the time of extracting the workpiece.

EXAMPLE 4

The workpiece was sliced in the same conditions as Example 1 except that the traveling speed of the wire was 1 m/min at the time of extracting the workpiece from the wire and the supply temperature of the slurry was 35° C. at the time of extracting the workpiece, and the same evaluation as Example 1 was made.

As a result, it was revealed that the saw mark and the amount of the Warp on the surface of the workpiece were greatly reduced in comparison with the case of using a conventional wire saw and that the amount of the reduction was larger than Example 1 to 3 when the traveling speed of the wire was 1 m/min, which was 2 m/min or less, at the time of extracting the workpiece from the wire, and the supply temperature of the slurry was 35° C., which was higher than the temperature of the slurry at the end of slicing, at the time of extracting the workpiece.

EXAMPLE 5

The workpiece was sliced in the same conditions as Example 1 except that the traveling speed of the wire was 0.5 m/min at the time of extracting the workpiece from the wire, the traveling distance in a forward direction was 0.3 m at the time of extracting the workpiece and the traveling distance in a backward direction was 0.2 m at the time of extracting the workpiece, and the same evaluation as Example 1 was made.

As a result, it was revealed that the saw mark and the amount of the Warp on the surface of the workpiece were reduced in comparison with the case of using a conventional wire saw and that the amount of the reduction was larger than Example 1 when the traveling speed of the wire was 0.5 m/min, which was 2 m/min or less, at the time of extracting the workpiece from the wire, the traveling distance in a forward direction was 0.3 m, which was 1 m or less, at the time of extracting the workpiece and the traveling distance in a backward direction was 0.2 m, which was 1 m or less, at the time of extracting the workpiece.

EXAMPLE 6

The workpiece was sliced in the same conditions as Example 1 except that the traveling speed of the wire was 0.5 m/min at the time of extracting the workpiece from the wire, the traveling distance in a forward direction was 0.3 m at the time of extracting the workpiece, the traveling distance in a backward direction was 0.2 m at the time of extracting the workpiece and the supply temperature of the slurry was 35° C. at the time of extracting the workpiece, and the same evaluation as Example 1 was made.

As a result, it was revealed that the saw mark and the amount of the Warp on the surface of the workpiece were greatly reduced in comparison with the case of using a conventional wire saw and that the amount of the reduction was larger than Example 1 to 3 when the traveling speed of the wire was 0.5 m/min, which was 2 m/min or less, at the time of extracting the workpiece from the wire, the traveling distance in a forward direction was 0.3 m, which was 1 m or less, at the time of extracting the workpiece and the traveling distance in a backward direction was 0.2 m, which was 1 m or less, at the time of extracting the workpiece and the supply temperature of the slurry was 35° C., which was higher than the temperature of the slurry at the end of slicing, at the time of extracting the workpiece.

COMPARATIVE EXAMPLE 1

The workpiece was sliced in the same conditions as Example 1 except that the traveling speed of the wire was 10 m/min at the time of extracting the workpiece from the wire, the traveling distance in a forward direction was 20 m at the time of extracting the workpiece and the traveling distance in a backward direction was 10 m at the time of extracting the workpiece, and the same evaluation as Example 1 was made.

As a result, it was revealed that the saw mark and the amount of the Warp on the surface of the workpiece were degraded in comparison with Example 1 when the traveling speed of the wire was 10 m/min, which exceeded 2 m/min, at the time of extracting the workpiece from the wire, the traveling distance in a forward direction was 20 m, which exceeded 1 m, at the time of extracting the workpiece and the traveling distance in a backward direction was 10 m, which exceeded 1 m, at the time of extracting the workpiece.

COMPARATIVE EXAMPLE 2

The workpiece was sliced in the same conditions as Example 1 except that the traveling speed of the wire was 100 m/min at the time of extracting the workpiece from the wire, the traveling distance in a forward direction was 200 m at the time of extracting the workpiece and the traveling distance in a backward direction was 100 m at the time of extracting the workpiece, and the same evaluation as Example 1 was made.

As a result, it was revealed that the saw mark and the amount of the Warp on the surface of the workpiece were greatly degraded in comparison with Example 1 when the traveling speed of the wire was 100 m/min, which exceeded 2 m/min, at the time of extracting the workpiece from the wire, the traveling distance in a forward direction was 200 m, which exceeded 1 m, at the time of extracting the workpiece and the traveling distance in a backward direction was 100 m, which exceeded 1 m, at the time of extracting the workpiece.

COMPARATIVE EXAMPLE 3

The workpiece was sliced in the same conditions as Example 1 except that the traveling speed of the wire was 3 m/min at the time of extracting the workpiece from the wire, and the same evaluation as Example 1 was made.

As a result, it was revealed that the saw mark and the amount of the Warp on the surface of the workpiece were degraded in comparison with Example 1 although the saw mark and the amount of the Warp were better than Comparative Example 1 when the traveling speed of the wire was 3 m/min, which exceeded 2 m/min, at the time of extracting the workpiece from the wire.

Table 1 shows the combined results of the quality evaluation of the workpiece slicing surface at the time of extracting the workpiece and the conditions in each of Examples and Comparative Examples.

TABLE 1

| | TRAVELING SPEED OF WIRE AT THE TIME OF EXTRACTING WORKPIECE | TRAVELING DISTANCE OF WIRE IN FORWARD/ BACKWARD DIRECTION AT THE TIME OF EXTRACTING WORKPIECE | SUPPLY TEMPERATURE OF SLURRY AT THE TIME OF EXTRACTING WORKPIECE | WAFER QUALITY BY EXTRACTING WORKPIECE |
|---|---|---|---|---|
| EXAMPLE 1 | 2 m/min | 1 m/0.5 m | 25° C. | ○ |
| EXAMPLE 2 | 1 m/min | 1 m/0.5 m | 25° C. | ◎ |
| EXAMPLE 3 | 2 m/min | 1 m/0.5 m | 35° C. | ◎ |
| EXAMPLE 4 | 1 m/min | 1 m/0.5 m | 35° C. | ◎◎ |
| EXAMPLE 5 | 0.5 m/min | 0.3 m/0.2 m | 25° C. | ◎ |
| EXAMPLE 6 | 0.5 m/min | 0.3 m/0.2 m | 35° C. | ◎◎ |
| COMPARATIVE EXAMPLE 1 | 10 m/min | 20 m/10 m | 25° C. | X |
| COMPARATIVE EXAMPLE 2 | 100 m/min | 200 m/100 m | 25° C. | XX |
| COMPARATIVE EXAMPLE 3 | 3 m/min | 1 m/0.5 m | 25° C. | X |

As described above, the workpiece sliced with the wire row can be extracted from the wire row without a negative influence on the slicing surface of the workpiece by using the wire saw according to the present invention that controls in such a manner that the workpiece is extracted while the wire is caused to travel at a speed of 2 m/min or less at the time of extracting the workpiece from the wire row after slicing the workpiece.

It is to be noted that the present invention is not restricted to the foregoing embodiment. The embodiment is just an exemplification, and any examples that have substantially the same feature and demonstrate the same functions and effects as those in the technical concept described in claims of the present invention are included in the technical scope of the present invention.

The invention claimed is:

1. A method for slicing a workpiece by using a wire saw, including:

winding a wire for slicing around a plurality of rollers to form a wire row;

driving the wire for slicing axially in a reciprocating direction; and slicing the workpiece simultaneously at a plurality of points arranged in an axial direction by feeding the workpiece against the wire row with the workpiece cut into while a slurry is supplied to the wire for slicing, wherein the workpiece is extracted while the wire is caused to travel at a speed in the range of 0.1 m/min to 2 m/min at the time of extracting the workpiece from the wire row after slicing the workpiece.

2. The method for slicing a workpiece by using a wire saw according to claim 1, the wire is caused to travel at the time of extracting the workpiece in such a manner that both traveling distances in a forward direction and a backward direction are 1 m or less respectively.

3. The method for slicing a workpiece by using a wire saw according to claim 1, a temperature of the slurry supplied at the time of extracting the workpiece is higher than a temperature of the slurry at the end of slicing.

4. The method for slicing a workpiece by using a wire saw according to claim 2, a temperature of the slurry supplied at the time of extracting the workpiece is higher than a temperature of the slurry at the end of slicing.

5. A wire saw comprising:

a wire for slicing wound around a plurality of rollers to form a wire row, the wire for slicing configured to be driven axially in a reciprocating direction, the wire saw being configured to simultaneously slice a workpiece at a plurality of points arranged in an axial direction by feeding the workpiece against the wire row and by cutting into the workpiece while a slurry is supplied to the wire for slicing, the wire saw further comprising a control unit for controlling in such a manner that the workpiece is extracted while the wire is caused to travel at a speed in the range of 0.1 m/min to 2 m/min at the time of extracting the workpiece from the wire row after slicing the workpiece.

6. The wire saw according to claim 5, wherein the control unit is configured to control the wire to be caused to travel at the time of extracting the workpiece in such a manner that both traveling distances in a forward direction and a backward direction are 1 m or less respectively.

7. The wire saw according to claim 5, wherein the control unit is configured to control a temperature of the slurry supplied at the time of extracting the workpiece so as to be higher than a temperature of the slurry at the end of slicing.

8. The wire saw according to claim 6, wherein the control unit is configured to control a temperature of the slurry supplied at the time of extracting the workpiece so as to be higher than a temperature of the slurry at the end of slicing.

* * * * *